United States Patent [19]

Cardillo

[11] Patent Number: 4,979,921

[45] Date of Patent: Dec. 25, 1990

[54] SHOULDER-SUPPORTED GUARDIAN ANGEL DOLL

[76] Inventor: J. Dolores Cardillo, 77 Salisbury St., Hull, Mass. 02045

[21] Appl. No.: 249,300

[22] Filed: Sep. 26, 1988

[51] Int. Cl.[5] ..... A63H 33/00

[52] U.S. Cl. ..... 446/26; 446/28; 446/901; D21/169

[58] Field of Search ..... 446/26, 27, 28, 268, 446/901, 369, 370, 371, 372, 395; D21/169; D3/42, 46, 50, 166; 2/75, DIG. 6; 273/DIG. 30; 272/8 N, 8 R

[56] References Cited

U.S. PATENT DOCUMENTS

| | | | |
|---|---|---|---|
| D. 128,039 | 7/1941 | Erdos | D21/169 |
| D. 281,801 | 12/1985 | Koh | D21/169 |
| D. 286,422 | 10/1986 | Dickerson | D21/169 |
| 1,437,467 | 12/1922 | Dykman | 446/369 |
| 1,644,827 | 10/1927 | Goldenberg | 446/371 |
| 2,312,286 | 2/1943 | Reich | 446/268 |
| 2,549,695 | 4/1951 | Linder | 2/75 |
| 2,591,379 | 4/1952 | Schradermeier | 446/268 |
| 2,593,218 | 4/1952 | Swain | 446/28 |
| 2,754,121 | 7/1956 | Jupiter | 446/26 |
| 3,789,547 | 2/1974 | Chemarin | 446/369 |
| 3,808,418 | 4/1974 | Conard | 446/369 |
| 4,140,164 | 2/1979 | Staup | D3/42 |
| 4,170,086 | 10/1979 | Hills | 446/372 |
| 4,197,670 | 4/1980 | Cox | 446/369 |
| 4,208,832 | 6/1980 | Corriveau | 446/901 |
| 4,235,042 | 11/1980 | Hills | 273/DIG. 30 |
| 4,249,337 | 2/1981 | Edson | 446/372 |
| 4,280,292 | 7/1981 | Hills | 446/28 |
| 4,571,206 | 2/1986 | Mayer | 446/330 |
| 4,595,618 | 6/1986 | Caringer | 446/28 |
| 4,662,550 | 5/1987 | O'Donnell | 446/26 |
| 4,778,172 | 10/1988 | Bryan | 446/395 |
| 4,802,469 | 2/1989 | Gollestani | 2/DIG. 6 |

FOREIGN PATENT DOCUMENTS

| | | | |
|---|---|---|---|
| 8802605 | 4/1988 | World Int. Prop. O. | 446/28 |

*Primary Examiner*—Robert A. Hafer
*Assistant Examiner*—Michael Brown
*Attorney, Agent, or Firm*—David Silverstein

[57] ABSTRACT

This invention relates to a children's doll in the form of a guardian angel which is designed to rest on a child's shoulder or elsewhere. The doll has a human-like torso with a pleasing, child-like face and a pair of wings which attaches to the doll's back. The shoulder support system includes two straps: the first having interlocking loop type fasteners at either end thereof on the same strap side; the second having interlocking loop type fasteners at either end thereof but on opposite strap sides. The interlocking loop fasteners of the two straps engage corresponding interlocking loop fasteners on the front and back of the doll's torso at one end of said straps and each other at the opposite end of said straps to hold the doll securely and adjustably in place on a child's shoulder.

16 Claims, 9 Drawing Sheets

SHOULDER-SUPPORTED GUARDIAN ANGEL DOLL

BACKGROUND OF THE INVENTION AND DISCUSSION OF PRIOR ART

The concept of a "guardian angel" keeping watch over every human being is deeply ingrained in the Judeo-Christian heritage. This invention is intended to translate the abstract concept of a "guardian angel" into an actual physical embodiment which children can see, play with, and wear on their shoulders to "keep watch" over them.

The prior art is replete with both design and utility patents directed to dolls and doll-like figures, including many which are intended to simulate angels. For example, the following U.S. patents show dolls having wing spans of various types: D-56,667; D-58,300; and D-255,476. U.S. Pat. No. D-286,422 shows a doll having both wings and a halo. In addition, there are numerous patents directed to doll-like figurines with wings intended, for example, as Christmas tree ornaments. Some examples of these patents include: D-128,039; D-219,925; D-193,995; D-216,642 and 2,312,286.

The prior art further shows dolls in which one or more of the doll's limbs or extremities is capable of at least limited movement, such as rotation or bending, to better simulate a human being or animal. For example, U.S. Pat. No. 1,189,585 (Kruse) shows a relatively simple such mechanism in which in- ternal wound wire coils restrain movement except at the doll's joints (elbows, knees, hips, etc.) where straight wire segments permit limited bending and twisting. In U.S. Pat. No. 1,446,466 (Huth), the doll is constructed around a skeleton-like frame made of lead or a similarly flexible metal capable of bending back and forth without breaking. Various types of ball and socket joints are also well-known in the art of doll construction.

It is also known in the prior art to construct dolls having interlocking loop type fasteners, such as "Velcro" (Reg. TM), for fastening various extremities to one another or to other objects, such as a ball, which have mating loop fasteners thereon. U.S. Pat. No. 4,280,292 (Hills), for example, shows a manipulatable toy puppet which is partially supported on the torso of the puppeteer with "Velcro"-type loop fasteners at the ends of the puppet's arms. The puppet's arms can thereby be detachably secured across one shoulder of the puppeteer. U.S. Pat. No. 4,729,751 (Schiavo et al.) shows a human-like doll with a patch of interlocking loop fasteners in each palm of its hands to hold a pen with a mating patch of loop fasteners on the barrel of the pen. This patent further shows doll clothing including mating patches of loop fasteners for securing the clothing in place.

U.S. Pat. No. 4,498,613 (Donahue) shows an adjustable shoulder strap with "Velcro"-type loop fasteners on the ends which is designed to help a parent support a nursing bottle for an infant. Instead of supporting a nursing bottle, in other embodiments the Donahue shoulder strap can be used to support a toy animal or a pacifier to free both the parent's hands without danger that the supported object will fall to the ground and thereby become contaminated.

All of the aforementioned prior art patents are incorporated herein by reference. None of these various patents, however, teaches the invention of a shoulder-supported guardian angel doll as described hereinafter.

OBJECTS OF THE INVENTION

A principal object of this invention is to provide a shoulder-supported guardian angel doll.

A further object of this invention is to provide an angel-like doll figure with detachable wings, clothing that can be put on and removed, and a torso capable of rotation or bending movements at key positions such as the waist, hips, knees, elbows, shoulders, fingers and neck. Also encompassed by this invention is a doll figure with moving mouth and eyes.

Still a further object of this invention is to provide a comfortable adjustable, and readily detachable shoulder support system for securing an angel or other doll on a child's shoulder or elsewhere.

Specifically, it is an object of this invention to provide an angel doll having interlocking loop fasteners on the front and back of the doll's torso or, alternatively, on the front and back of a removable doll vest, which fasteners mate with corresponding loop fasteners on the ends of a pair of support straps.

These and other objects and advantages of this invention will become apparent in the following description.

DETAILED DESCRIPTION AND PREFERRED EMBODIMENTS

Figure 1:
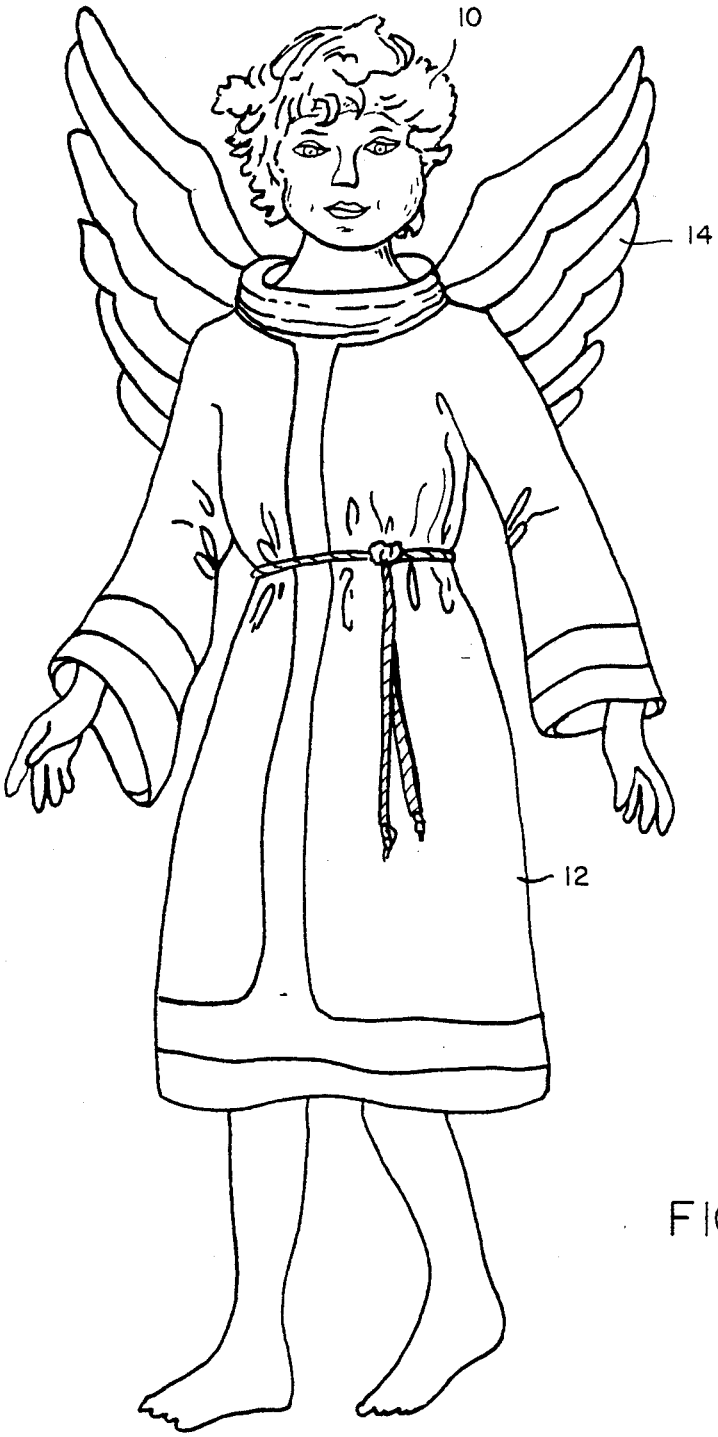
FIG. 1 is a schematic front view of the guardian angel doll of this invention.

FIG. 1 shows the guardian angel doll 10 of this invention fully clothed in doll gown 12 with a part of the doll's wings 14 visible on the doll's back. The doll as shown has a human-like form with a head, torso, two arms with hands and fingers, and two legs with feet and toes. Also as shown, in the preferred embodiment the doll has a pleasing, child-like face and simulated hair.

None of the specific features of the form of the doll, however, is critical to the invention. For example, the arms, hands, legs, and feet are optional. The facial appearance is a matter of choice and imagination. The doll's wings are also optional. Indeed, this invention is not limited to a human-like doll figure at all. For example, this invention would work equally well with a toy animal figure such as one in the form of a parrot, designed to perch on a child's shoulders. All of these variations are intended to be included within the scope of this invention.

Figure 2:
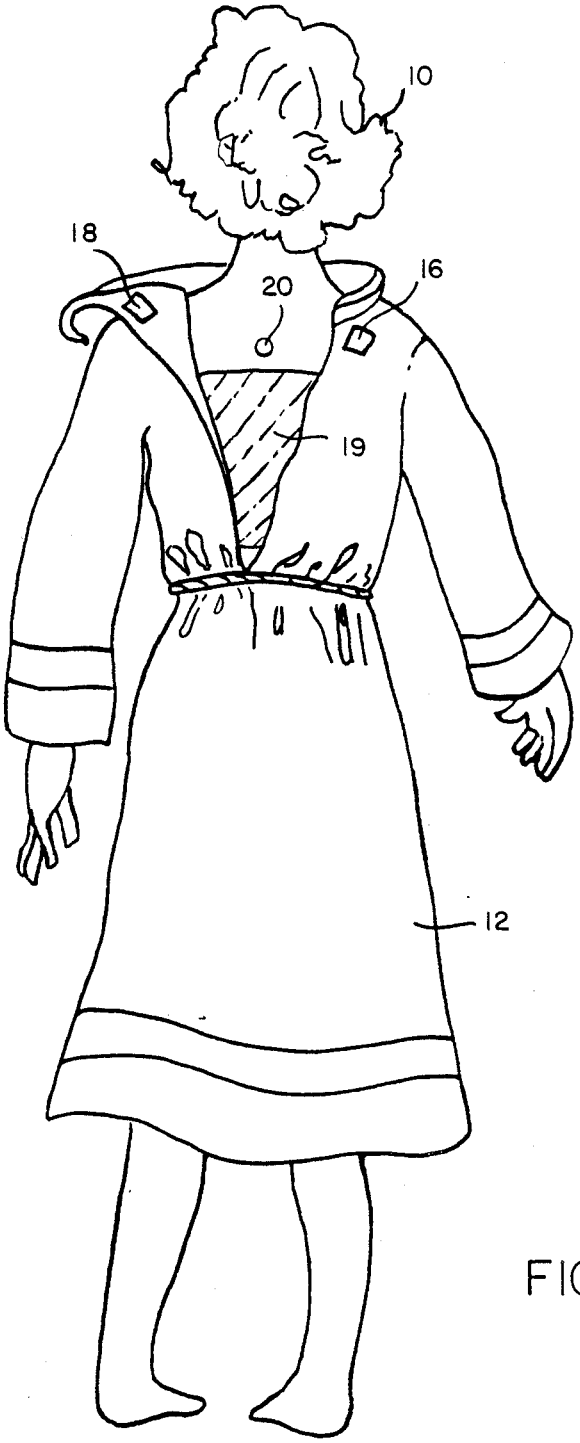
FIG. 2 is a schematic rear view of the guardian angel doll with the wings removed and the back of the doll's gown partly open from the waist to the neck.

FIG. 2 shows a rear view of the guardian angel doll 10. In FIG. 2, the doll gown 12 is partly open from the waist to the doll's neck and the wings are removed to show an aperture 20 in the rear of the doll's torso. The back of doll gown 12 can be partially fastened along the back with interlocking loop fasteners 16 and 18 to leave a partly open seam 19 which permits access to aperture 20. Alternatively, an aperture in the back of gown 12 aligned more or less with torso aperture 20 could be used to access aperture 20.

Figure 3:
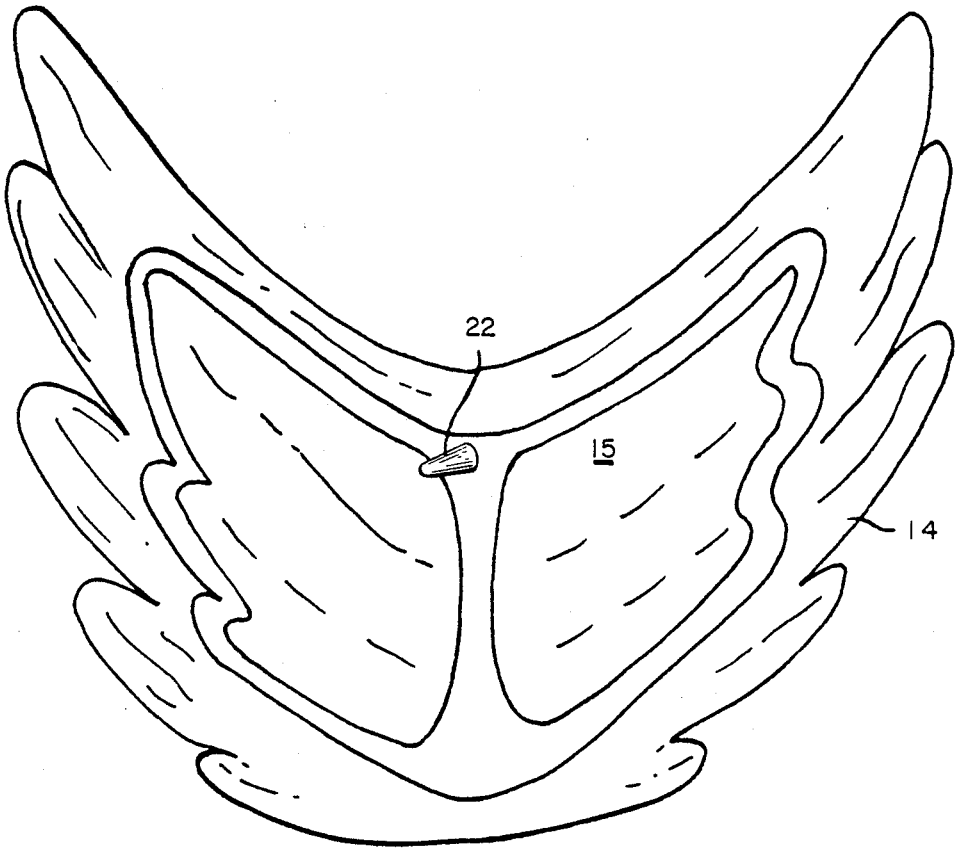
FIG. 3 is an enlarged schematic view of the inner face of the angel doll wing assembly.

FIG. 3 shows an enlarged view of the inner face 15 of the doll's wings 14. The inner face is here defined as that face which is closest to and facing toward the back of the angel doll when the wings are attached thereto. The outer face of the wings (not seen in this view) is that face which would be seen by an observer looking at the angel doll from behind. The particular form, shape, or design of the wings is not critical to this invention. Alternative wing designs are well known in the art, and all of these variations are intended to be included within the scope of this invention.

Wings 14 include an outwardly tapered projection or inverted cone 22 extending outwardly from inner face 15 and designed to mate with aperture 20 on the rear of the angel doll's torso, as shown in FIG. 2. In the preferred embodiment, projection 22 is positioned at the approximate center of gravity of inner face 15. This arrangement for readily detachable angel doll wings facilitates attaching and detaching the shoulder support system to and from the angel doll as described below. Alternatively, wings 14 could be detachably secured to the doll's rear torso with mating interlocking loop type fasteners on the wings and the torso. Still another type of readily detachable wing support comprises a magnet and iron plate combination. These and other well known means for detachably securing one object to another are all intended to be included within the scope of this invention.

Figure 4:
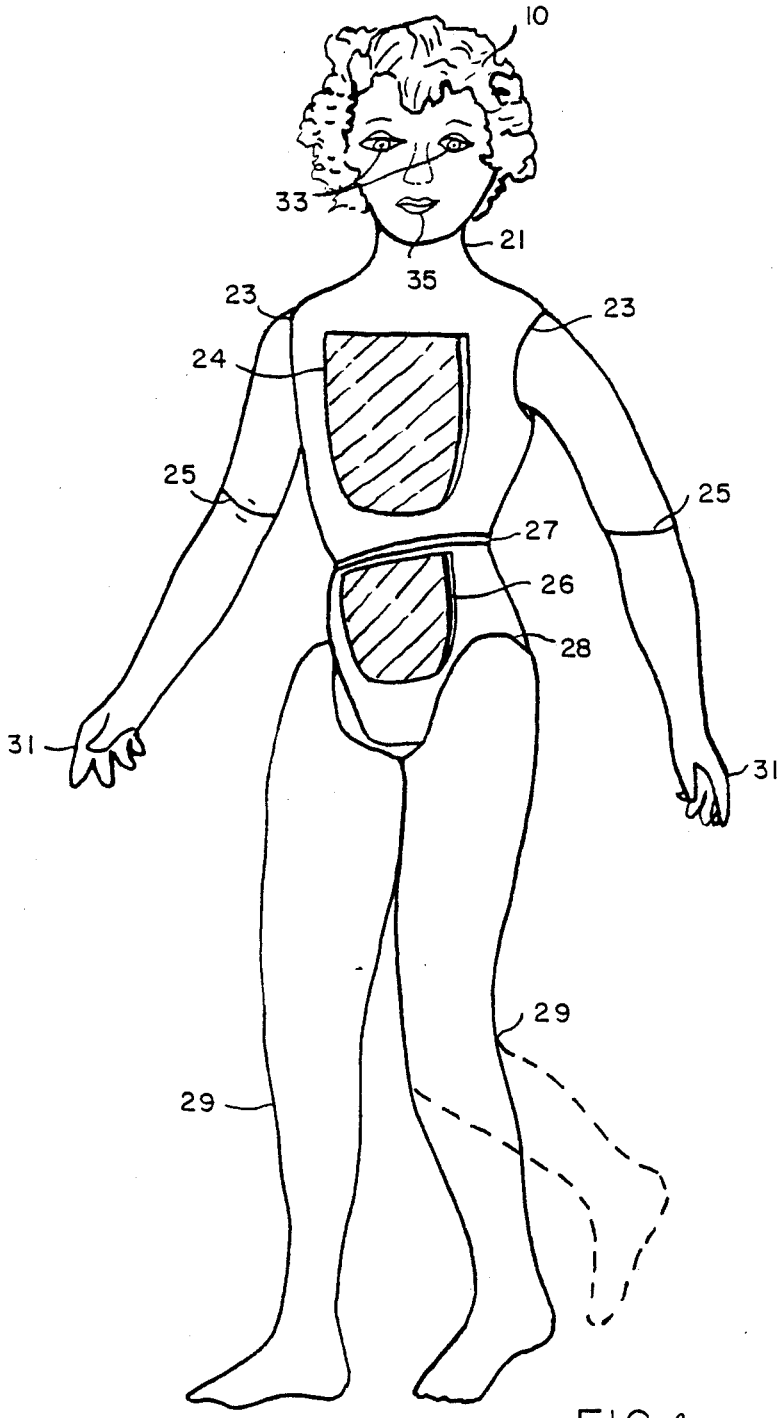
FIG. 4 is a schematic front view of the angel doll with the doll's gown removed to show one embodiment of the invention in which fastening means are attached directly to the doll's torso.

FIG. 4 shows the front torso of angel doll 10 including front torso strips 24 and 26 of interlocking loop type fastener permanently attached to the upper and lower halves of the doll's front torso. In interlocking loop type fastener systems comprising a smooth surface mating with a rough surface, it is preferred that strips 24 and 26 consist of the smooth surface to give the doll a more pleasant appearance and feel. In some applications, it may be possible to eliminate either one of strips 24 and 26 and still maintain adequate support for the doll's shoulder support system. In other applications, it is possible to combine strips 24 and 26 into a single elongated strip.

FIG. 4 further shows swivel or bendable connections at the doll's neck 21, shoulder joints 23, elbows 25, waist 27, hips 28, knees 29 and fingers 31. One or more of these swivel or bendable connections can be eliminated without affecting this invention. For example, the angel doll of this invention may be fashioned in a permanent sitting position with no swivel or bendable connections whatsoever. In some embodiments, the doll may also have moveable eyes 33 and a moveable mouth 35.

Figure 5:
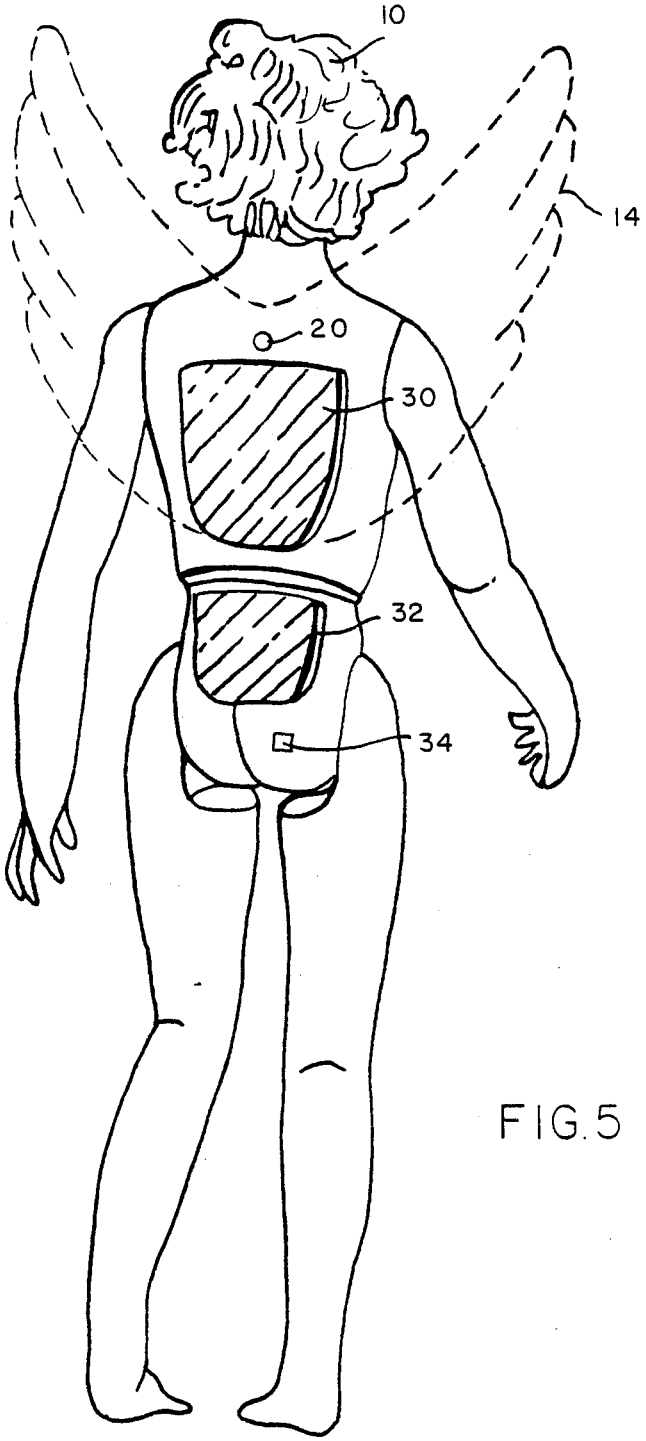
FIG. 5 is a schematic rear view of the angel doll with the doll's gown removed to show a rear view of the embodiment of FIG. 4 in which fastening means are directly attached to the doll's torso.

FIG. 5 shows the rear torso of angel doll 10 including rear torso strips 30 and 32 of interlocking loop type fastener permanently attached to the upper and lower halves of the doll's rear torso. For reasons discussed above, it is preferred that strips 30 and 32 consist of the smooth part of the interlocking loop fastener system. Wings 14 are shown in dotted outline. In some applications, it may be possible to eliminate either one of strips 30 and 32 and still maintain adequate support for the doll's shoulder support system. In other applications, it is possible to combine strips 30 and 32 into a single elongated strip.

FIG. 5 further shows a closed compartment 34 on the rear torso of the doll. Compartment 34 comprises a cavity in the rear torso and a removable cover. In one embodiment of the invention, a microprocessor can be located within compartment 34 together with a power source such as a battery. The microprocessor and power source can be adapted for various specialized functions: the doll can thereby be made to talk, move, or light up in the dark, for example. Such variations and specialized adaptations, and the means for achieving these effects, are well known in the art. All of these modifications are intended to be within the scope of this invention.

Figure 6:
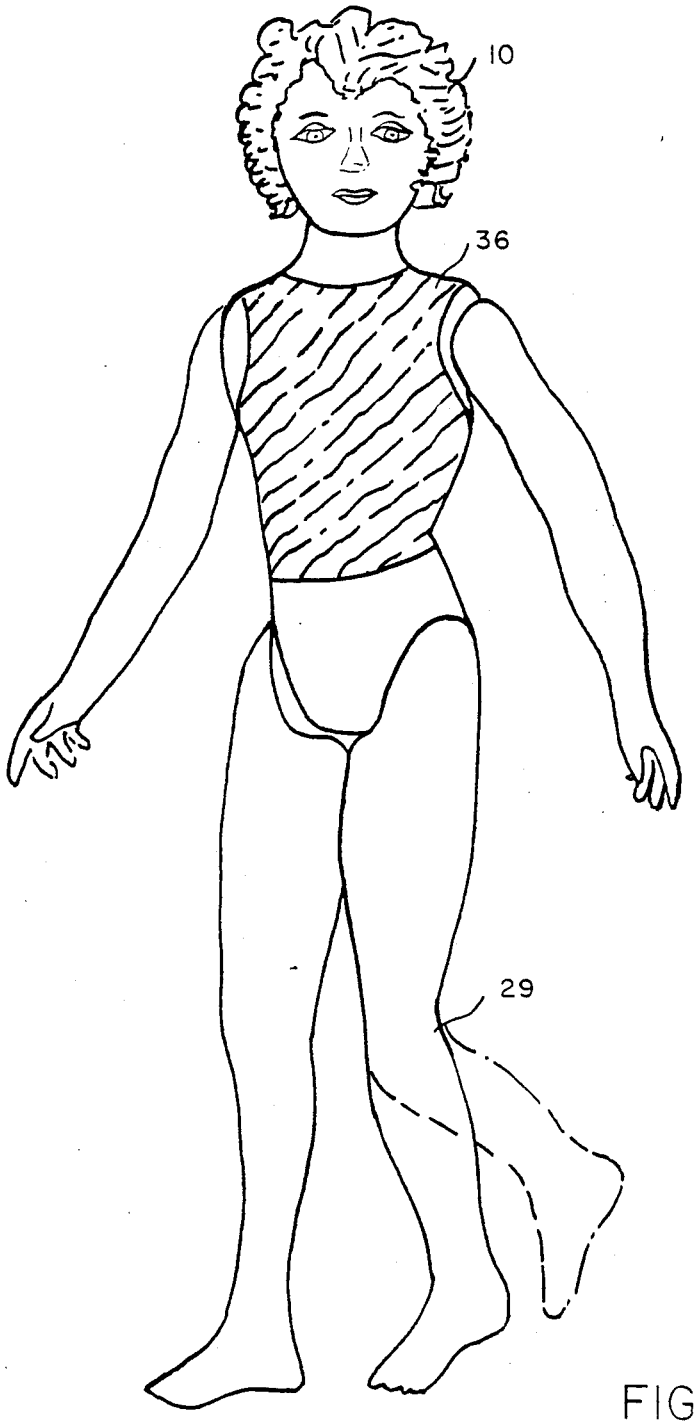
FIG. 6 is a schematic front view of the angel doll with the doll's gown removed to show the detachable vest embodiment of this invention.

FIG. 6 shows a front torso view of a modified detachable vest embodiment of the shoulder support system of this invention. Instead of utilizing strips of interlocking loop type fasteners permanently attached to the front and rear of the doll's torso as shown in FIGS. 4 and 5, in this detachable vest embodiment the doll 10 is wearing a removable, elastic, snug-fitting vest 36, the outside of which comprises interlocking loop type fasteners. At least a portion of both the front and back exterior sides of the vest are made up of the interlocking loop fasteners. It is also within the scope of this invention to have the entire exterior of the vest comprised of interlocking loop fasteners. For reasons discussed above, it is preferred that the vest portion comprising the interlocking loop fasteners consist of the smooth side of the fastener system. The vest may be of the slip-on variety, or else it may utilize conventional button, zipper, snap, or hook and clasp fastener means to secure it around the torso of the doll. Vest 36 can be made of any soft, stretchable material, including natural and synthetic fabrics and combinations thereof.

Figure 7:
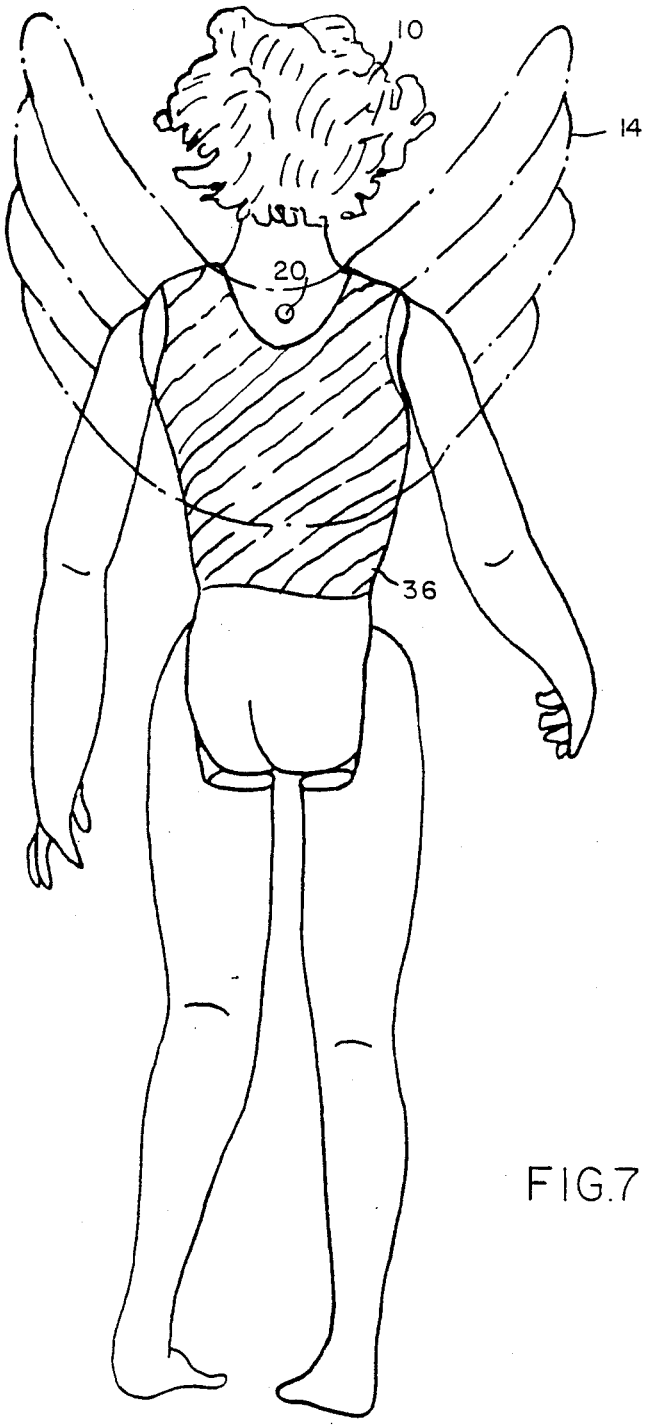
FIG. 7 is a schematic rear view of the angel doll with the doll's gown removed to show the detachable vest embodiment of this invention.

FIG. 7 shows a rear torso view of the detachable vest embodiment of this invention. Wings 14 are shown in dotted outline. As shown in FIG. 7, the rear of vest 36 has a U-neck shape at the doll's neckline so as to leave aperture 20 exposed and accessible. Alternatively, vest 36 can be made with an aperture in back aligned more or less with torso aperture 20.

Figure 8:
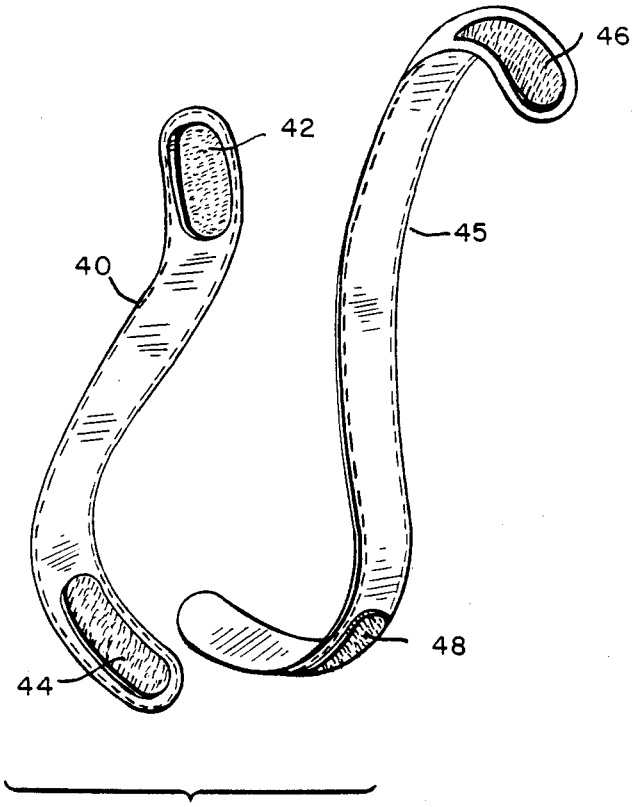
FIG. 8 is a schematic perspective view of the mating shoulder support straps of this invention showing the interlocking loop fasteners at the ends thereof.

FIG. 8 shows the mating shoulder support straps of this invention. Front strap 40 comprises an inner-facing side, an outer-facing side, and two elongated strips of interlocking loop fasteners 42 and 44, one at each opposite end of the inter-facing side. Rear strap 45 comprises an inner-facing side, an outer-facing side, and two elongated strips of interlocking loop fasteners, interlocking strip 46 located at one end of strap 45 on the inner-facing side, and interlocking strip 48 located at the other end of strap 45 on the outer-facing side. As shown, interlocking strips 44 and 48 are designed to mate with each other. Interlocking strip 42 is designed to mate with either front torso strips 24 and 26 (FIG. 4) or with the interlocking loop portion of the front of vest 36 (FIG. 6). Interlocking strip 46 is designed to mate with either rear torso strips 30 and 32 (FIG. 5) or with the interlocking loop portion of the rear of vest 36 (FIG. 7).

Straps 40 and 45 may range in length from about 10–36 inches depending on the size of the person on whose shoulder the doll will sit. It is also within the scope of this invention to have one or both of straps 40 and 45 adjustable in length using conventional means. Straps 40 and 45 should be generally flat on the sides and range in width from about ¼–3 inches depending on the size and weight of the angel doll. Straps 40 and 45 should also generally be as thin as possible consistent with maintaining adequate tensile strength against tearing while in use. Typically a thickness of about 1/32–⅛ inch will be satisfactory depending on the material used.

Straps 40 and 45 may be fashioned out of any flexible, lightweight material which is pliable. For example, woven natural or synthetic fabric may be used for straps 40 and 45, as well as leather and some types of plastic and similar synthetic polymers. In one embodiment, straps 40 and 45 are made of elasticized fabric to better secure the doll on a shoulder. In an alternative embodiment, a portion of one or both of straps 40 and 45 are made of an elastic material. All of these modifications are intended to be within the scope of this invention.

Figure 9:
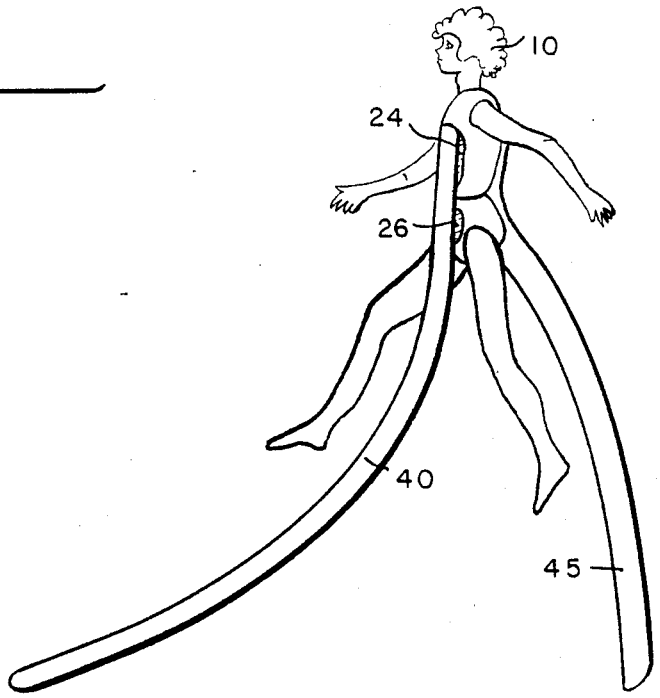
FIG. 9 is a schematic side view of the angel doll showing the shoulder support straps attached to the fastening means on the front and back of the doll's torso as shown in FIGS. 4 and 5.

FIG. 9 shows the shoulder support straps 40 and 45 of this invention attached to one embodiment of angel doll 10. Shown in FIG. 9 is the embodiment of angel doll 10 in which strips 24 and 26 of interlocking loop fasteners are permanently affixed to the doll's front torso (FIG. 4), and other strips (not shown in FIG. 9) of interlocking loop fasteners are permanently affixed to the doll's rear torso (FIG. 5). In the detachable vest embodiment of angel doll 10 (FIGS. 6 and 7), strips 42 and 46 respectively of straps 40 and 45 would attached to the front and back respectively of the vest.

Figure 10:
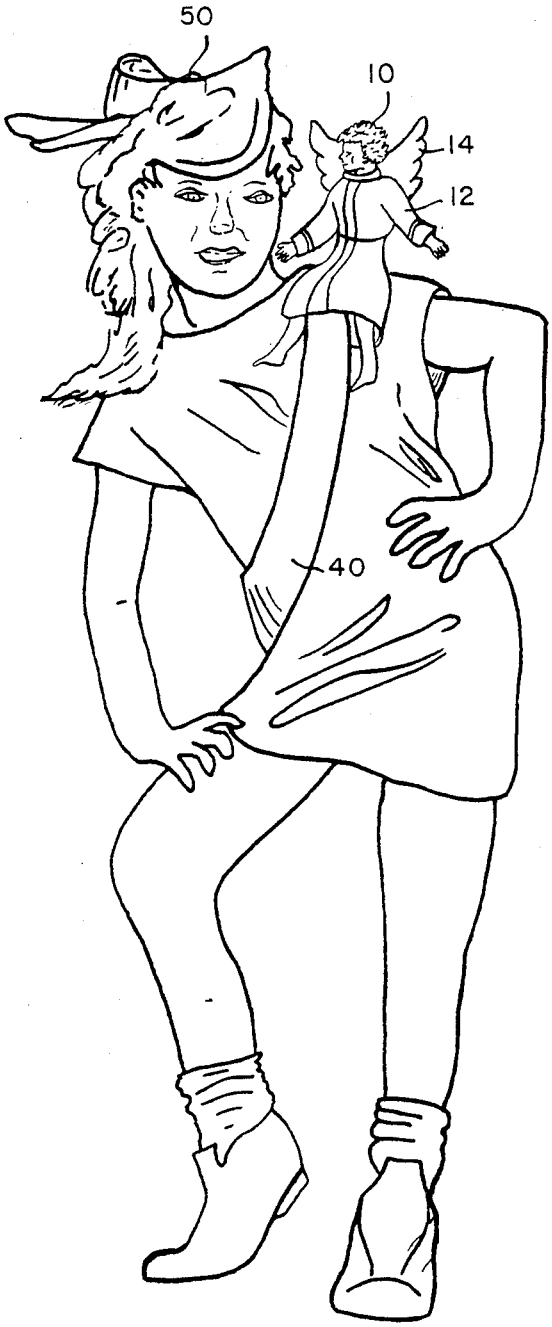
FIG. 10 is a schematic front view showing the guardian angel doll of this invention supported by the shoulder support system of this invention on the shoulder of a child.

FIG. 10 shows a child 50 wearing angel doll 10 of this invention on her shoulder using the shoulder support system of this invention, which includes, in part, front shoulder strap 40. Strap 40 runs from the child's left shoulder down and across her chest to her right hip where it connects with strap 45 (not shown) which runs from the child's left shoulder down and across her back. As seen in FIG. 10, the doll's gown 12 covers and disguises the interlocking loop fasteners which are either on the doll's torso or else on the doll's vest. The gown, vest (in that embodiment), and shoulder straps do not interfere in any way with the angel doll's wings 14.

This invention permits a child to quickly and easily secure the angel doll to his or her shoulder. The angel doll can be worn comfortably for extended periods of time. The tension in the support straps is readily adjustable. The doll and the simplified shoulder support system of this invention permit children to quickly and easily move the doll from the shoulder of one child to that of another so that sharing of this toy is encouraged. All of the parts are readily disassembled to facilitate cleaning and storage.

Many other variations and modifications of my basic design will be readily apparent to those skilled in the art. All such variations and modifications are within the spirit and the scope of this invention, and, therefore, are intended to be encompassed by the following claims.

Having described my invention, what I claim is:

1. A toy figure and support device therefor comprising in combination:

(a) a toy figure comprising a head portion and a torso portion, said torso portion having front and rear sides each having torso interlocking loop fasteners permanently secured thereto; and, (b) independent strap means that are completely detachable from said toy figure and said torso loop fasteners, said strap means being generally flat with top and bottom sides, and having a thickness of about 1/32–⅛ inch and a width of about ¼–3 inches, said strap means further characterized in having strips of interlocking loop fasteners at opposite ends of one side thereof that respectively engage and attach to the loop fasteners on said front and rear sides of said torso portion.

2. The toy figure of claim 1 wherein said figure comprises an angel doll with a human appearance, a child-like face, and a single wing structure comprising two wings.

3. The toy figure of claim 2 wherein said wing structure is detachably connected to the torso portion of said toy figure.

4. The toy figure of claim 3 wherein the torso portion of said toy figure includes a single aperture that mates with a singe substantially evenly tapered projection on said wing structure.

5. The toy figure of claim 2 additionally wherein said angel doll has moveable arms, legs and fingers.

6. The toy figure of claim 2 additionally wherein said angel doll has a bendable waist connection such that the doll can be positioned in either a sitting or a standing position.

7. The toy figure of claim 2 additionally wherein said angel doll has moveable eyes and a moveable mouth.

8. The toy figure of claim 2 further wherein said strap means comprise two straps: the first having interlocking loop fasteners at either end thereof on the same strap side; the second having interlocking loop fasteners at either end thereof on opposite strap sides.

9. A toy figure and support device therefor comprising in combination:

(a) a toy figure comprising a head portion and a torso portion, said torso portion having front and rear sides each having torso interlocking loop fasteners permanently secured thereto; and, (b) independent strap means that are completely detachable from said toy figure and said torso loop fasteners, said strap means being generally flat with outer and inner-facing sides, and having a thickness of about 1/32–⅛ inch and a width of about ¼–3 inches, further wherein said strap means comprise first strap means having an outer-facing side and an inner-facing side with a strip of interlocking loop fastener at each end of the first strap means on said inner-facing side thereof, and second strap means having an outer-facing side with a strip of interlocking loop fasteners at one end of said second strap means on said outer-facing side thereof and an inner-facing side with a strip of interlocking loop fasteners on said inner-facing side at the end of said second strap means opposite from the end having the strip of interlocking loop fasteners on said outer-facing side.

10. A toy figure and support device therefor comprising in combination:

(a) a toy figure comprising a head portion and a torso portion;

(b) an article of clothing having front and rear outside faces that snugly surround the torso portion of said toy figure, said article of clothing comprising clothing interlocking loop fasteners permanently attached to said front and rear outside faces of said article of clothing; and, (c) independent strap means that are completely detachable from said toy figure and said clothing loop fasteners, said strap means being generally flat with top and bottom sides and having a thickness of about 1/32–⅛ inch and a width of about ¼–3 inches, further wherein said strap means have strips of interlocking loop fasteners at opposite ends of one side thereof for respectively engaging the loop fasteners on said front and rear outside faces of said article of clothing.

11. The toy figure of claim 10 further wherein said strap means comprise two straps: the first having interlocking loop fasteners at either end thereof on the same strap side; the second having interlocking loop fasteners at either end thereof on opposite strap sides.

12. The toy figure of claim 11 wherein said figure comprises an angel doll with a human appearance, a child-like face, and a single wing structure comprising two wings.

13. The toy figure of claim 12 wherein said wing structure is detachably connected to the torso portion of said toy figure.

14. The toy figure of claim 13 wherein the torso portion of said toy figure includes a single aperture that mates with a single tapered projection on said wing structure.

15. In a toy figure comprising an angel-like doll having a head and a torso having a front and a rear, the improvement comprising a shoulder support system which comprises torso fastening means permanently attached to said front and rear of said doll torso and independent strap means that are completely detachable from said toy figure and said torso fastening means, said strap means being generally flat with top and bottom sides, and having a thickness of about 1/32–⅛ inch and a width of about ¼–3 inches, said strap means further characterized in having strap fastening means opposite at ends thereof that mate with and attach to said torso fastening means.

16. In the toy figure and shoulder support system of claim 15, the improvement comprising first strap means having an outer-facing side and an inner-facing side with a strip of interlocking loop fasteners at each end of the first strap means on said inner-facing side thereof, and second strap means having an outer-facing side with a strip of interlocking loop fasteners at one end of said second strap means on said outer-facing side thereof and an inner-facing side with a strip of interlocking loop fasteners on said inner-facing side at the end of said second strap means opposite from the end having the strip of interlocking loop fasteners on said outer-facing side.

* * * * *

UNITED STATES PATENT AND TRADEMARK OFFICE

CERTIFICATE OF CORRECTION

PATENT NO. : 4,979,921

DATED : December 25, 1990

INVENTOR(S) : J. Dolores Cardillo

It is certified that error appears in the above—identified patent and that said Letters Patent is hereby corrected as shown below:

Col. 6, line 24 - delete "singe" and insert therefor

-- single --.

Col. 8, line 13 - after "means" insert the word -- at --.

Col. 8, line 14 - delete the word "at".

Signed and Sealed this

Ninth Day of March, 1993

*Attest:*

STEPHEN G. KUNIN

*Attesting Officer*

*Acting Commissioner of Patents and Trademarks*